US006058850A

United States Patent [19]

McCray et al.

[11] Patent Number: 6,058,850

[45] Date of Patent: May 9, 2000

[54] ADJUSTABLE TABLE ASSEMBLY FOR SEWING MACHINES AND THE LIKE

[76] Inventors: Nora H. McCray, 1019-69th St., Boulder, Colo. 80303; Anna Zapp, 333 Wisteria Way, Lafayette, Colo. 80026; Paul D. Whittle, 1013 Turnberry Cir., Lousville, Colo. 80027

[21] Appl. No.: 08/869,544

[22] Filed: Jun. 5, 1997

Related U.S. Application Data

[60] Provisional application No. 60/035,678, Jan. 22, 1997.

[51] Int. Cl.[7] ..... A47F 5/12

[52] U.S. Cl. ..... 108/1; 108/12

[58] Field of Search ..... 108/1, 3, 157.16, 108/157.15, 12, 19; 248/188.2, 688, 397, 371; 297/423.46, 423.45

[56] References Cited

U.S. PATENT DOCUMENTS

| | | | |
|---|---|---|---|
| D. 277,007 | 1/1985 | Rosenblad . | |
| 277,544 | 5/1883 | Chappell | 248/371 |
| 2,672,182 | 3/1954 | Gwin et al. | 108/90 |
| 2,683,067 | 7/1954 | Hartman . | |
| 3,561,383 | 2/1971 | Fresard et al. . | |
| 3,566,816 | 3/1971 | Zilg . | |
| 4,005,918 | 2/1977 | Smith et al. . | |
| 4,077,333 | 3/1978 | Ballas . | |
| 4,089,573 | 5/1978 | Aeschliman . | |
| 4,211,178 | 7/1980 | Peterson . | |
| 4,383,486 | 5/1983 | Reineman et al. . | |
| 4,440,096 | 4/1984 | Rice et al. . | |
| 4,610,416 | 9/1986 | Choi . | |
| 4,645,163 | 2/1987 | Zovar | 108/1 X |
| 5,108,089 | 4/1992 | Wilkinson | 108/12 X |
| 5,213,554 | 5/1993 | Goldstein et al. | 108/19 X |
| 5,231,562 | 7/1993 | Pierce et al. | 108/50.02 X |
| 5,248,286 | 9/1993 | Wilkinson et al. | 108/12 X |
| 5,295,452 | 3/1994 | Frye et al. . | |
| 5,555,819 | 9/1996 | Lochridge | 108/1 X |
| 5,732,928 | 3/1998 | Chang | 248/688 |

FOREIGN PATENT DOCUMENTS

| | | | |
|---|---|---|---|
| 2910442 | 11/1979 | Germany | 248/398 |

OTHER PUBLICATIONS

Guangyan, Li et al, *Factors Affecting Posture for Machine Sewing Tasks*, pp. 35–46.

*Primary Examiner*—Jose V. Chen
*Attorney, Agent, or Firm*—Emery Tracy

[57] ABSTRACT

An adjustable table assembly for use with a portable sewing machine and positionable upon a table surface is provided. The assembly comprises a main table base having a first edge, a second edge opposite the first edge, and a substantially planar top surface between the first edge and the second edge. A support member is mounted to the first edge of the main table base and extends at an angle from the top surface of the main table base creating a tilt angle between the main table base and the table surface. An adjustment mechanism is associated with the support member for selectively adjusting the tilt angle of the main table base to a desired tilt angle. The main table base receives the sewing machine thereby tilting the sewing machine at the desired tilt angle.

14 Claims, 11 Drawing Sheets

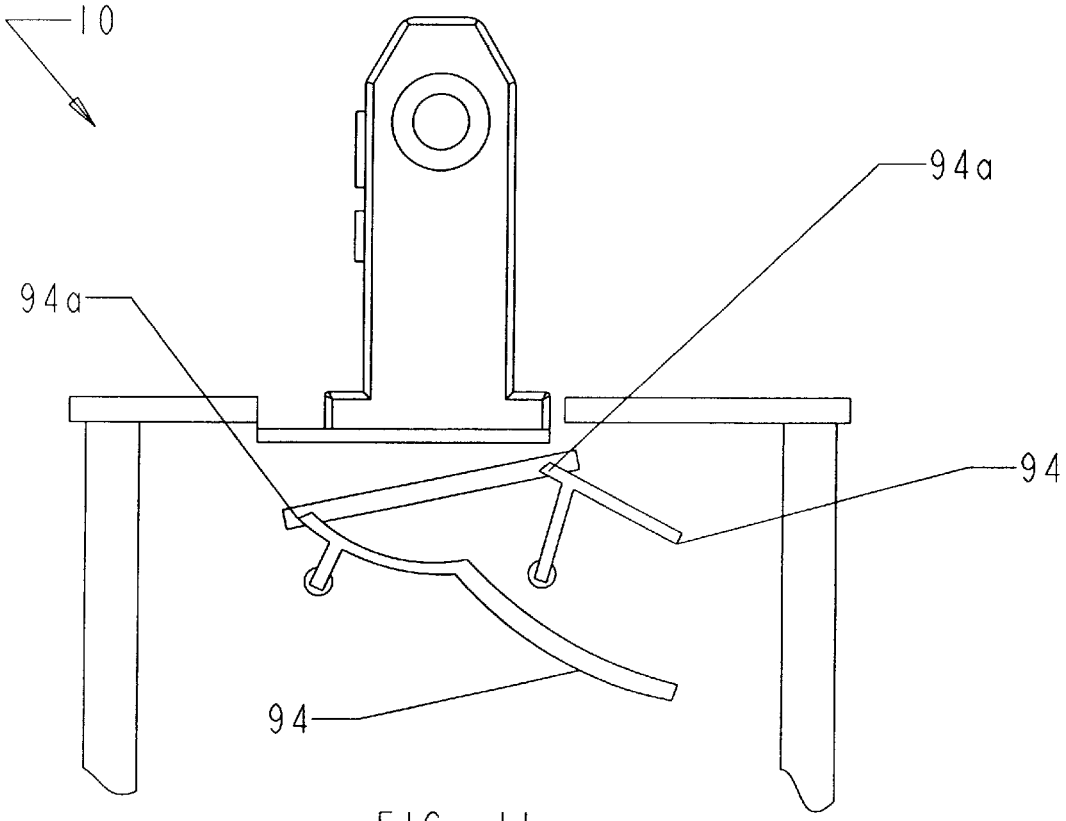
FIG. 11
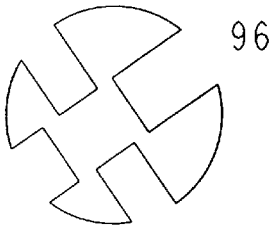
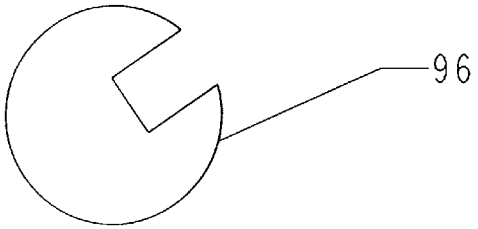

ADJUSTABLE TABLE ASSEMBLY FOR SEWING MACHINES AND THE LIKE

The present application is a continuation-in-part of pending provisional patent application Ser. No. 60/035,678, filed on Jan. 22, 1997.

BACKGROUND OF THE INVENTION

1. Field of the Invention

This invention relates generally to adjustable table assemblies for sewing machines and the like and, more particularly, it relates to adjustable table assemblies for sewing machines and the like which adjustably tilt the sewing machines positioned thereon for achieving improved and correct ergonomic body posture of the sewing machine operator during sewing operations.

2. Description of the Prior Art

Typically, sewing machines are constructed having a base and a sewing arm mounted to and above the base. The sewing machine base includes a sewing area for placement of objects to be sewn which is directly under a sewing needle reciprocally mounted within the sewing arm. During operation of the sewing machine, the operator must position herself or himself in such a manner as to view the sewing area. Many times, such viewing position is having the operator lean awkwardly forward with her or his head twisted, bent over, and strained to view the sewing area resulting in loss of visual clarity and work production. Besides having to assume an ergonomically incorrect and uncomfortable seating position, if the operator can not easily view the sewing area, injury to the operator may occur by the sewing needle during sewing operations.

Currently, an increased awareness of ergonomic and body friendly workstations exists in many industries. In fact, many professional seamstresses and other sewing operators suffer from muscular and skeletal problems of the neck, shoulders, back, hips, wrists, and other body parts due to poor ergonomic posture and operational working positions at their workstation. The operator's posture is constrained by both the visual limitations of the sewing machine itself and the manual aspects of the job. For the sewing machine operator, as in other professions, it is important to provide a correct ergonomic work station for better vision of the needle area, more physical comfort and work precision, and easier operation of the sewing area of the sewing machine. Increasing physical comfort often results in better productivity and worker longevity.

It is an object of the present invention to provide an adjustable table for sewing machines and the like which improve the correct ergonomic posture of the sewing machine operator thereby decreasing sewing machine related injuries, including, but not limited to, the muscular skeletal system.

It is another object of the present invention to provide an adjustable table for sewing machines and the like which improve the visual capabilities of the sewing area of the sewing machine by the sewing machine operator thereby further decreasing sewing machine related injuries.

It is yet a further object of the present invention to provide an adjustable table for sewing machines and the like which are vertically adjustable to tilt the sewing machine toward the operator for increasing the correct ergonomic posture and visual capabilities of the sewing machine operator during operation of the sewing machine.

It is still a further object of the present invention to provide an adjustable table for sewing machines and the like which basically convert a standard table work surface into a vertically adjustable, correct ergonomic work station for the portable sewing machine operator.

SUMMARY OF THE INVENTION

The present invention is an adjustable table assembly for use with a portable sewing machine and positionable upon a table surface or a cabinet tray. The assembly of the present invention comprises a main table base having a first edge, a second edge opposite the first edge, and a substantially planar top surface between the first edge and the second edge. A support member is mounted to the first edge of the main table base and extending at an angle from the top surface of the main table base with the support member creating a tilt angle between the main table base and the table surface. Adjustment means are associated with the support member for selectively adjusting the tilt angle of the main table base to a desired tilt angle wherein the main table base receiving the sewing machine and the sewing machine being tilted at the desired tilt angle.

In an embodiment of the present invention, the adjustment means comprise the support member having a plurality of notches of varying depth. The adjustment means further comprise an adjustment leg having a notch with the notch of the support member matingly receivable in the notch of the adjustment leg thereby adjusting the tilt angle of the main table base.

In another embodiment of the present invention, the adjustment means comprise the support member having a plurality of vertically aligned apertures. The adjustment means further comprise an adjustment leg having a notch and a bolt receiving aperture through the notch with the bolt receiving aperture alignable with the apertures of the support member and the support member matingly receivable in the notch. The adjustment means further yet comprise a bolt extending through one of the apertures of the support member and the bolt receiving aperture of the adjustment leg thereby adjusting the tilt angle of the main table base.

In yet another embodiment of the present invention, the adjustment means comprise the main table base having a bottom surface opposite the top surface with the bottom surface having a plurality of slots. The adjustment means further comprise an adjustment leg matingly receiving in one of the slots of the bottom surface thereby adjusting the tilt angle of the main table base. Preferably, the adjustment leg has either a substantially L-shaped configuration or a substantially triangular configuration.

In still another embodiment of the present invention, the adjustment means comprise adjustment legs mounted adjacent the second edge of the main table base. The adjustment legs are vertically adjustable relative to the table surface thereby adjusting the tilt angle of the main table base.

In still yet another embodiment of the present invention, the sewing machine is mountable within a sewing cabinet with the sewing cabinet having a pair of side wall panels and the table surface retractable within the sewing cabinet between the side wall panels. The adjustment means comprises hinge means mounted to the main table base nearingly adjacent the second side edge for tilting the main table base with clasping means mounted nearingly adjacent the first side edge of the main table base for interacting with side wall panels adjusting the tilt angle of the main table base.

Preferably, the assembly of the present invention further comprises clamping means for releasably securing the main table base to the table surface. Additionally, preferably, the main table base has a bottom surface opposite the top surface and the assembly further comprises movement inhibiting means mounted to the bottom surface adjacent the second side edge of the main table base for inhibiting movement of the main table base relative to the table surface. The movement inhibiting means preferably comprise a member selected from the group consisting of nylon bumpers, rubber bumpers, and suction cups.

Furthermore, the assembly of the present invention further comprises an aperture formed in the main table base with an electrical cord on the sewing machine receivable within the aperture. In addition, the assembly further comprises a lip member mounted to the second side edge of the main table base.

The present invention also provides an adjustable table assembly for use with a sewing machine mounted within a sewing machine cabinet. The sewing machine cabinet has a pair of side wall panels, an end wall panel between the side wall panels, and a table surface for positioning the sewing machine retractable between the side wall panels. The assembly comprises at least one adjustable hinge mounted on the end wall panel for supporting the table surface. The hinge is movable in a generally vertical direction along the end wall panel with the hinge being tiltable and releasably retainable in a desired tilt position relative to the end wall panel, wherein the table surface and the sewing machine positioned thereon is tilted.

BRIEF DESCRIPTION OF THE DRAWINGS

FIG. 11 is a perspective view of yet another embodiment of the adjustment means of the adjustable table of the present invention for use within a sewing machine cabinet and constructed in accordance with the present invention;

DETAILED DESCRIPTION OF THE PREFERRED EMBODIMENTS

Figure 1B:
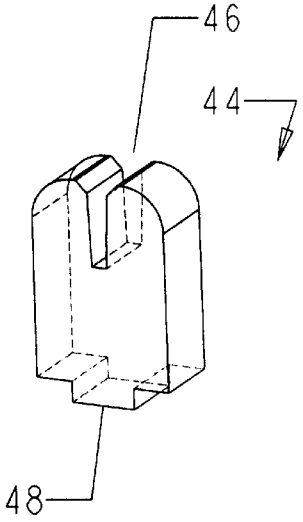
FIGS. 1*b* and 1*c* is are perspective views illustrating adjustment means for the embodiment of the adjustable table assembly as illustrated in FIG. 1 constructed in accordance with the present invention.
Figure 1A:
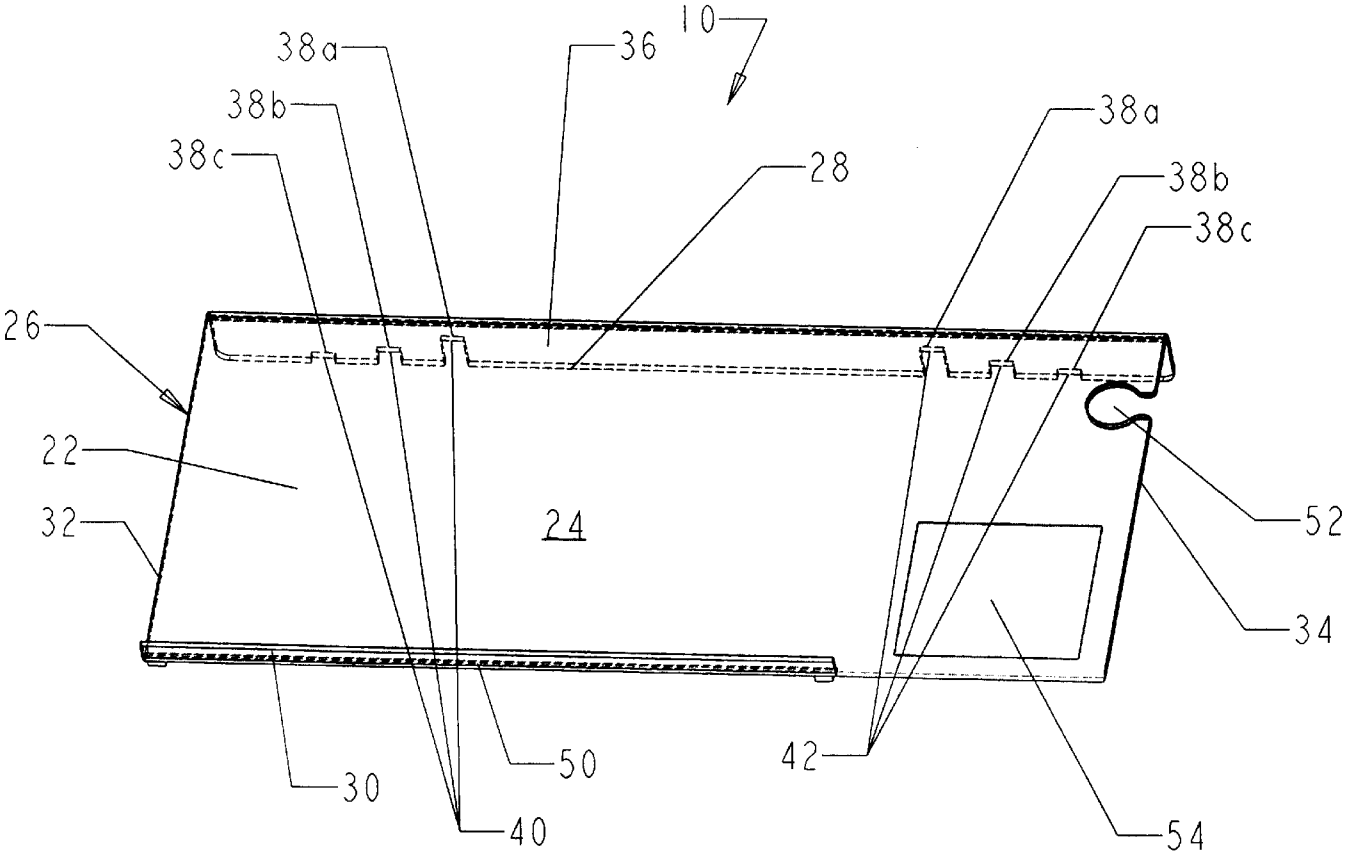
FIG. 1*a* is a perspective view illustrating an embodiment of the adjustable table assembly positionable on a table surface and constructed in accordance with the present invention.
Figure 1C:
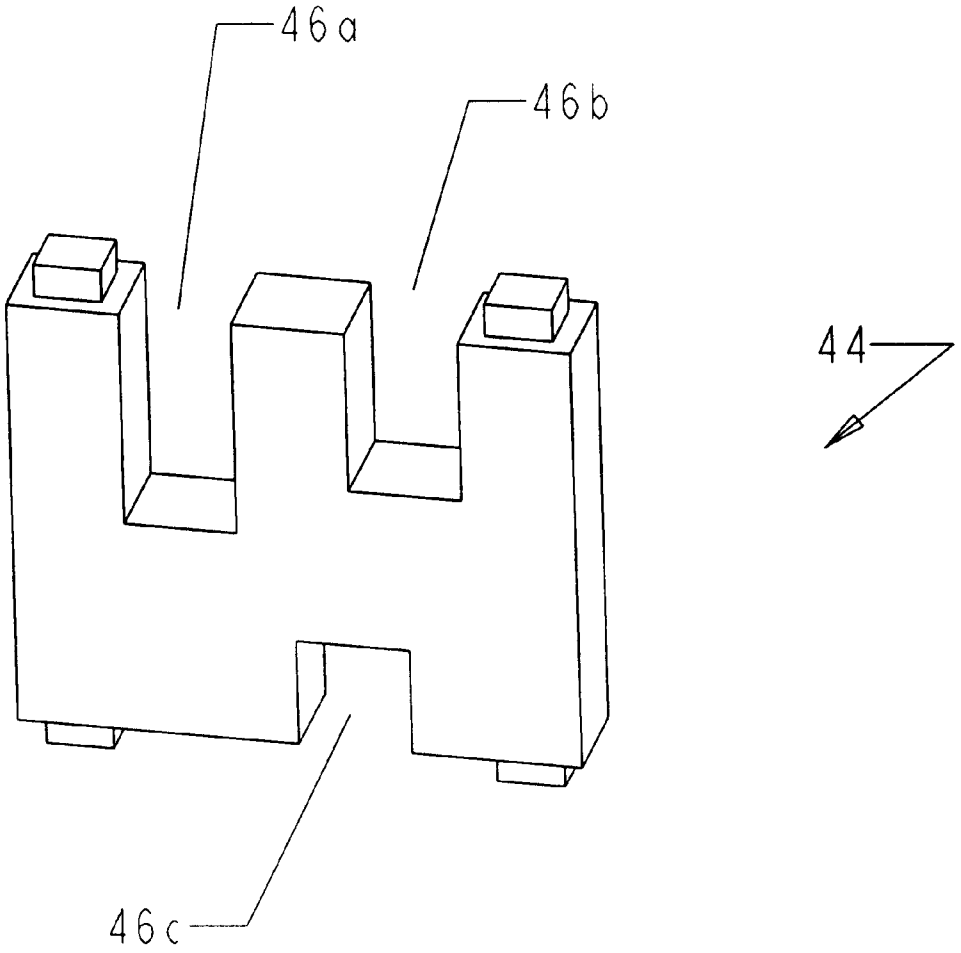
Figure 2:
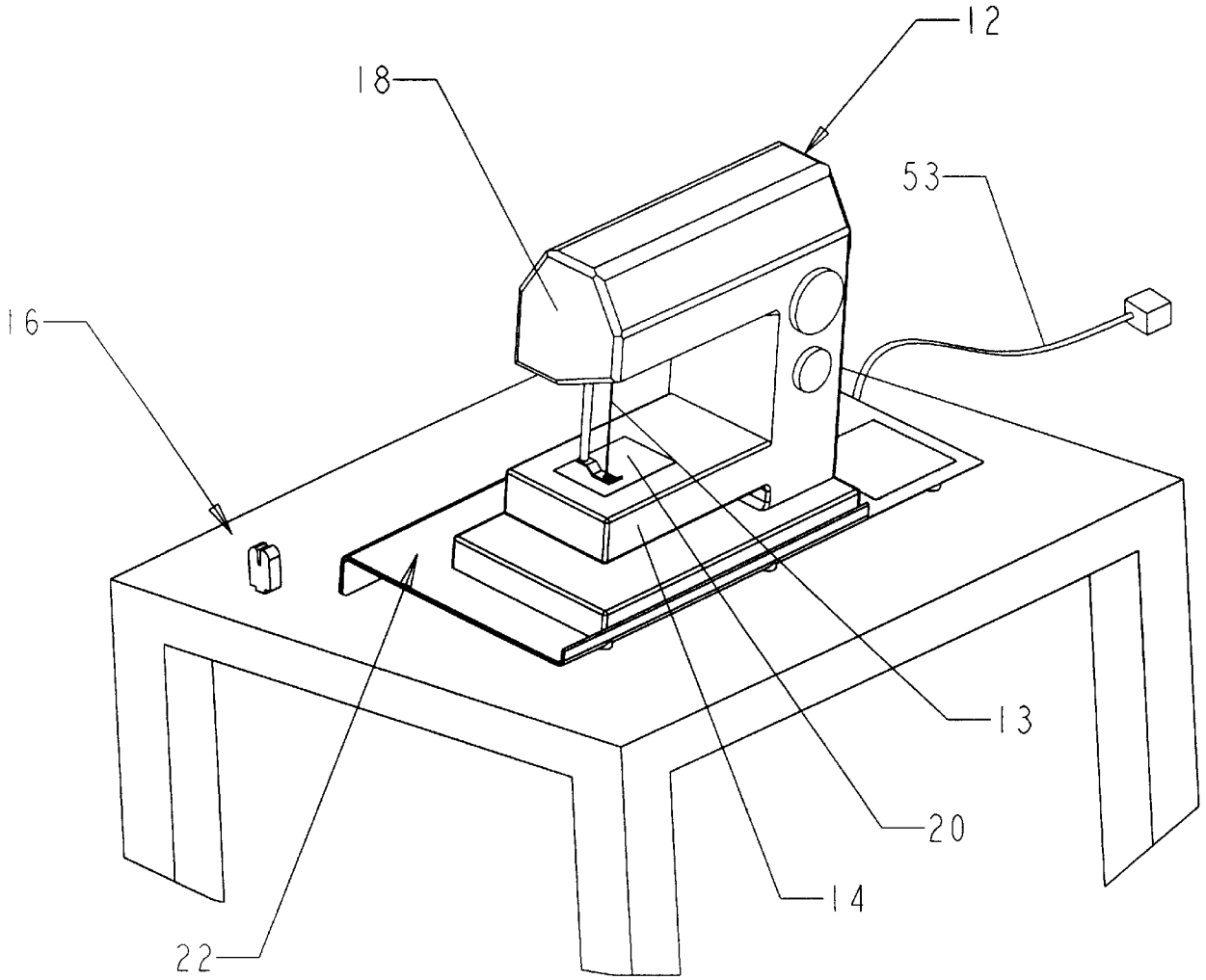
FIG. 2 is a perspective view illustrating positioning of a sewing machine thereon for the embodiment of the adjustable table assembly as illustrated in FIG. 1 constructed in accord with the present invention.

As illustrated in FIGS. 1 and 2, the present invention is an adjustable table assembly, indicated generally at 10, for portable sewing machines 12 and the like. Typically, the portable sewing machine 12 comprises a base portion 14 for resting on a table surface 16, an extended arm 18 mounted to the base portion 14, a needle 13 mounted in the extended arm 18 for reciprocal movement relative to the extended arm 18, and a substantially planar sewing area 20 on the base portion 14 for receiving the needle 13 and for placement of objects (not shown) to be sewn. While a particular type of portable sewing machine 12 as been described hereto, other existing and future types of portable sewing machines are within the scope of the present invention to be used with the adjustable table 10 of the present invention.

The adjustable table 10 of the present invention comprises a main table base 22 having a top surface 24, a bottom surface 26 opposite the top surface 24, a first side edge 28, a second side edge 30 opposite the first side edge 28, a third side edge 32 between and substantially perpendicular to the first and second side edges 28, 30, and a fourth side edge 34 opposite and substantially parallel to the third side edge 32. While being described as being substantially rectangular, the main table base 22 can have a variety of geometric shapes including, but not limited to, square, multi-sided, round, oval, etc. Regardless of the geometric shape of the main table base 22, it is preferable that the first and second side edges 28, 30 of the main table base 22 have a length of approximately substantially nineteen and one-half (18½") inches and the third and fourth side edges 32, 34 of the main table base 22 have a length of approximately nine and one-quarter (9¼") inches. Furthermore, it is important in the design of the adjustable table 10 of the present invention that the top surface 24 of the main table base 22 be sufficiently sized allowing placement of a standard-sized portable sewing machine thereon such that the base portion 14 of the sewing machine 12 is firmly and safely positionable upon the main table base 22 without the sewing machine 12 dislodging or otherwise falling from the main table base 22. Actual placement of the sewing machine 12 upon the main table base 22 will be described further below.

The main table base 22 of the adjustable table 10 of the present invention is preferably constructed from a clear acrylic plastic material which has been sized and shaped by laser cutting. Once again, while the main table base 22 has been described as being constructed from a laser-cut, clear acrylic plastic material, it is within the scope of the present invention to construct the main table base 22 from other materials including, but not limited to, other plastics, metal, wood, nylon, ceramic, rubber, paper, glass, etc., and to size and shape the main table base 22 by other means.

In a preferred embodiment, the adjustable table 10 further comprises a rear extension member 36 formed from the main table base 22 at the first edge 28 of the main table base 22 and extending substantially entirely across the first side edge 28 from the third side edge 32 to the fourth side edge 34. The rear extension member 28 preferably has a height of approximately one and one-half (1½") inches and formed by applying heat to the main table base 22 nearingly adjacent the first side edge 28 and bending the first side edge 28 to a position which is at an angle of approximately substantially less than ninety (90°) degrees from the main table base 22. Having the angle between the main table base 22 and the rear extension member 28 at an angle equal to or greater than ninety (90°) degrees, however, is also within the scope of the present invention.

The rear extension member 36 has a plurality of adjustment notches 38 formed the first side edge 28 of the main table base 22 with a first set 40 of adjustment notches 38 formed adjacent the third side edge 32 of the main table base 22 and a second set 42 of adjustment notches 38 formed adjacent the fourth side edge 34 of the main table base 22. The adjustment notches 38 preferably range, but not limited to, between substantially approximately one-quarter (¼") inch and three-quarters (¾") inch in depth. The first set 40 and the second set 42 of adjustment notches 38 have corresponding notches 38*a*, 38*b*, 38*c* of equal depth with each pair of corresponding notches having varying depth to each other pair of corresponding notches 38*a*, 38*b*, 38*c*. Corresponding varying depth notches 38*a*, 38*b*, 38*c* provide further stable adjustability of the tilt of the main table base 22 as will be described further below.

As illustrated in FIG. 1*b*, the adjustable table 10 of the present invention further comprises at least a pair of adjustment legs 44 releasably receivable within the adjustment notches 38 of the rear extension member 36 and preferably constructed from the same material as the main table base 22. It should be noted, however, that it is within the scope of the present invention to construct the adjustment legs 44 from a different material than ii the main table base 22.

Referring to FIGS. 1*a*, 1*b*, 1*c*, and 2, the adjustment legs 44 have a slot 46 or a plurality of various depth slots 46 formed therein and extending approximately substantially halfway through the adjustment legs 44. The slots 46 are sized and shaped for mating with the adjustment notches 38 of the rear extension member 36. Mounting the adjustment legs 44 in the corresponding notches 38*a* achieves the least amount of vertical tilt of the main table base 22. Mounting the adjustment legs 44 in the corresponding notches 38*b* achieves a greater amount of tilt of the main table base 22. Finally, mounting the adjustment legs 44 in the corresponding notches 38*c* achieves the greatest amount of tilt of the main table base 22.

In operation, depending on the desired tilt of the adjustable table 10, the slot 46 of one of the adjustment legs 44 is releasably secured in one corresponding adjustment notch 38*a*, 38*b*, 38*c* of the rear extension member 36 and the slot 44 of another adjustment leg 44 is releasably secured in the other corresponding adjustment notch 388*a*, 38*b*, 38*c* of the rear extension member 36. Placement of the adjustment legs 44 as described provides the adjustable table 10 of the present invention with a stable tilting, preferably between the angles often (10°) degrees and thirty (30°) degrees although having the adjustable table 10 tilt at an angle less than ten (10°) and more than thirty (30°) degrees is within the scope of the present invention.

The adjustment legs 44 further have a support footing 48 mounted on the adjustment legs 44 opposite each of the slots 46. The support footing 48 provides stable movement inhibiting positioning of the adjustable table 10 upon the table surface 16. Furthermore, the support footing 48 can be constructed from a vinyl material in the form of a vinyl bumper or can be a suction cup for releasably securing the adjustment legs 44 to the table surface 16. Other types of support footings 48 are also within the scope of the present invention.

Along with mounting support footings 48 to the adjustment legs 44, preferably, support footings 48 are also mounted to the bottom surface 26 of the main table base 22 nearingly adjacent the second side edge 30 of the main table base 22. Like the support footings 48 of the adjustment legs 44, the support footings 48 mounted to the bottom surface 26 of the main table base 22 inhibit movement of the adjustable table 10 upon the table surface 16.

Preferably, the adjustable table 10 further comprises a front extension member 50 formed from the main table base 22 nearingly adjacent the second side edge 30 of the main table base 22. The front extension member 50 is formed, similar to the rear extension member 36 by applying heat to the main table base 22 adjacent the second side edge 30 and bending the second side edge 30 to a position which is at an angle of approximately substantially ninety (90°) degrees from the main table base 22 while maintaining the support footings 48 members mounted to the bottom surface 26 of the main table base 22 in contact with the table surface 16. Having the angle between the main table base 22 and the front extension member 50 at an angle less than or greater than ninety (90°) degrees, however, is also within the scope of the adjustable table 10 of the present invention.

The front extension member 50 preferably extends from the third side edge 32 of the main table base 22 to approximately three-quarters along the second side edge 30 of the main table base 22 toward the fourth side edge 34 of the main table base 22. The front extension member 50 inhibits the sewing machine 12 positioned upon the top surface 24 of the main table base 22 from sliding or slipping off the main table base 22 when the adjustable table 10 is tilted to a desired angle by the mounting of the adjustment legs 44 to the rear extension member 36 of the main table base 22 as described above. It should be noted that the front extension member 50 does not have to extend three-quarters along the second side edge 30 but rather could extend less or more depending on the brand of the sewing machine 12 (some sewing machines have a knee lever extending outward from the sewing machine which would require that the front extension member 50 be a shorter length) to be positioned on the adjustable table 10.

The adjustable table 10 of the present invention further comprises a slotted aperture 52 formed in and adjacent the fourth side edge 34 of the main table base 22. The slotted aperture 52 is sized and shaped to releasably receive the electrical cords 53, if any, of the portable sewing machine 12. By positioning the electrical cords within the slotted aperture 52, the electrical cords are directed away from the second side edge 30 of the main table base 22 and the sewing machine 12 itself toward the first side edge 28 of the main table base 22 to inhibit the electrical cords from becoming entangled with the sewing machine operator and out of reach by small children. By inhibiting entanglement of the electrical cords of the sewing machine 12 with the operator, it is less likely that the operator will trip over the electrical cord and/or pull the electrical cords and the sewing machine 12 with the operator's legs when the operator sits down or stands adjacent the adjustable table 10.

The adjustable table 10 of the present invention further comprises optional accessory holding devices 54 mounted to the top surface 24 of the main table base 22. The accessory holding devices 54 can be in the form of clips, holders, or apertures in the top surface 24 of the main table base 22. Furthermore, it is within the scope of the present invention to apply an accessory holding device 54 in the form of an adhesive-backed magnetic surface to the top surface 24 of the main table base 22 for holding magnetically attractive items including, but not limited to, scissors, needles, pins, etc.

To mount the sewing machine 12 to the adjustable table 10 of the present invention, there are several available options. First, the sewing machine 12 can simply be placed on the top surface 24 of the main table base 22 of the tilted adjustable table 10 without additional attachment means. However, in order to further releasably or permanently mount the sewing machine 12 to the tilted adjustable table 10, additional attachment means can be used. For instance, hook and loop fasteners, i.e. VELCRO, can be mounted to both the sewing machine 12 and the top surface 24 of the main table base 22. The hook portion of the hook and loop fastener can be applied to the base portion 14 of the sewing machine 12 in a desired position (or the top surface 24 of the main table base 22) and the loop portion of the hook and loop fastener can be applied to the top surface 24 of the main table base 22 in a corresponding matable desired position (or the base portion 14 of the sewing machine 12). The mating of the hook portion of the hook and loop fastener with the loop portion of the hook and loop fastener releasably maintains the sewing machine 12 on the main table base 22 of the adjustable table 10 until removal of the sewing machine 12 is desired by the operator. It should be noted that other types of releasable mounting means including, but not limited to, clamps, bolts, etc., are within the scope of the present invention.

In another embodiment of the adjustable table 10 of the present invention, as best illustrated in FIG. 1*c*, the rear extension member 36 does not include the adjustment notches 38 as described above. In this embodiment, the first side edge 22 of the rear extension member 36 of the main table base 22 slides directly into the slots 46 in the adjustment legs 44. The adjustment legs can be manufactured be extrusion process or other means with varying depth slots 46*a*, 46*b*, 46*c* for receiving the first side edge 28 of the main table base 22 at the rear extension member 36.

Figure 3:
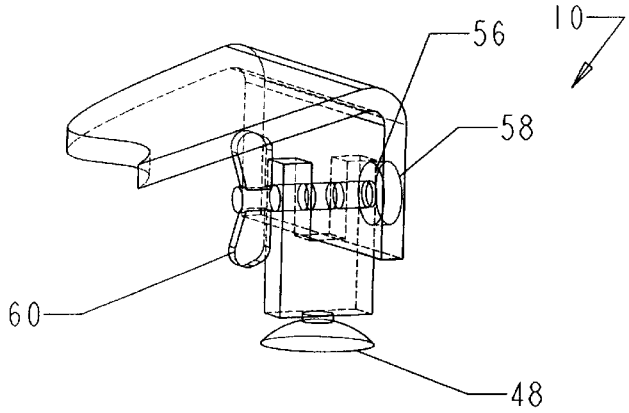
FIG. 3 is a perspective view of another embodiment of the adjustable table assembly and adjustment means positionable on a table surface and constructed in accordance with the present invention.

In the alternative, as illustrated in FIG. 3, the rear extension member 36 further has a plurality of corresponding vertically aligned apertures 56 formed therein at different distances from the first side edge 28. Preferably, a bolt or pin 58 extends through the slot 46 in each of the adjustment legs 44 and through the corresponding apertures 56 in the rear extension member 36 to achieve the desired tilt of the adjustable table 10. A wing nut 60 or other fastener can be attached to the bolt 58 to inhibit the bolt 58 from exiting or otherwise being removed, either accidentally or otherwise, from the adjustment legs 44 and the corresponding apertures 56 in the rear extension member 36. Once again, support footings 48, i.e., suction cups, can be mounted on the adjustment legs 44 to better assist in maintaining the adjustable table 10 on the table surface 16.

Figure 4:
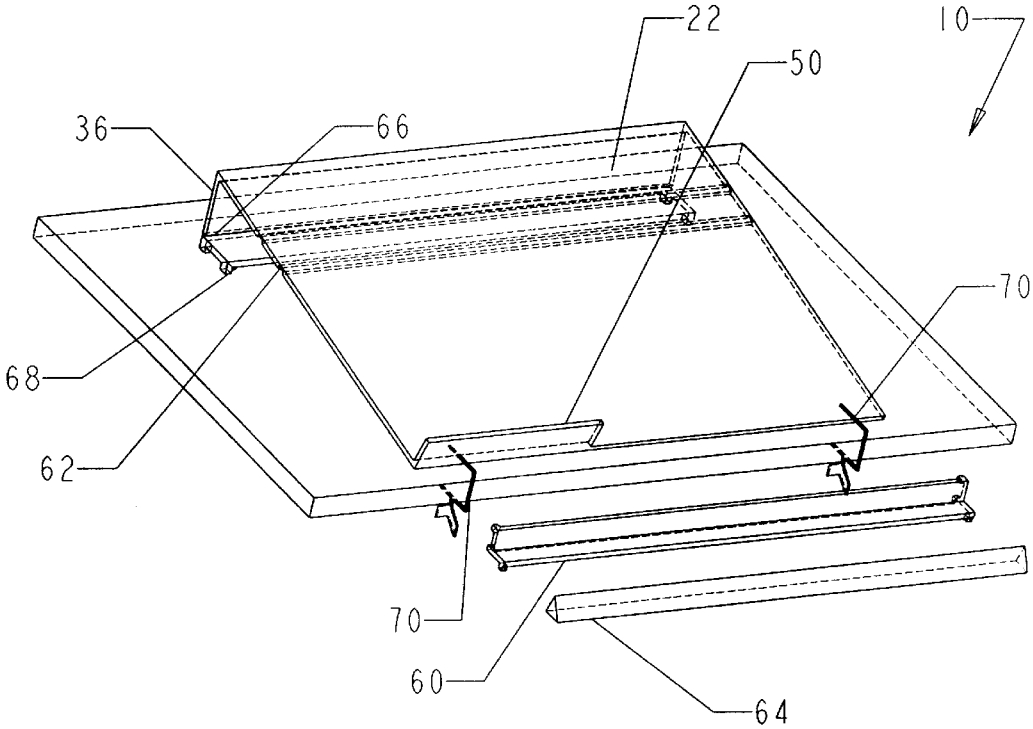
FIG. 4 is a perspective view of yet another embodiment of the adjustable table assembly and adjustment means positionable on a table surface and constructed in accord with the present invention.

In yet another embodiment of the adjustable table 10 of the present invention, as best illustrated in FIG. 4, the rear extension member 36 likewise does not include the adjustment notches 36 as described above. In this embodiment, at least one groove 62, preferably at least two grooves 62, is formed in the bottom surface 26 of the main table base 22 along the substantially entire length of the main table base 22. The adjustable table 10 further comprises an L-shaped leg or triangular leg 64 receivable within the grooves 62 to adjust the tilt of the main table base 22 of the adjustable table 10. The L-shaped leg 64 preferably has dimensions of approximately one and one-half (1½") inches by one and one-half (1½") to one and three-quarters (1¾") inches by nineteen and one-half (19½") inches. Depending on the desired tilt of the adjustable table 10, the L-shaped leg 64 can be releasably mounted within any of the grooves 62 in the bottom surface 26 of the main table base 22. Furthermore, support footings 48, i.e., vinyl bumpers, rubber stripping, or the like can be mounted to the L-shaped leg 64 to inhibit movement of the adjustable table 10 on the table surface 16.

In this embodiment of the adjustable table 10 of the present invention, it is desirable for the rear extension member 36 to also have a slip inhibiting surface. Therefore, the rear extension member 36 has an additional support leg 68 having a width of approximately one (1") inch and a length of approximately nineteen and one-half (19½") inches is adhesively mounted to the rear extension member 36. Support footings 48, i.e., vinyl bumpers, rubber stripping, or the like, are mounted to the support leg 68 adjacent the table surface 16 to inhibit slipping of the adjustable table 10 on the table surface 16. To further stabilize the adjustable table 10, a plurality of C-clamps 70 can be releasably secured nearingly adjacent the second side edge 30 of the main table base 22 and the table surface 16.

Figure 5:
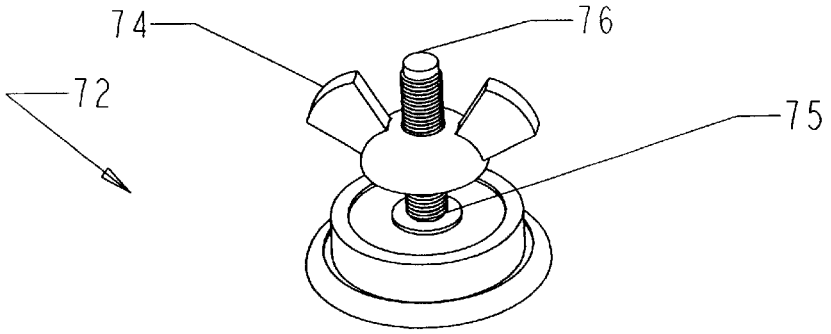
FIG. 5 is a perspective view of still another embodiment of the adjustment means constructed in accordance with the present invention.

In still another embodiment of the adjustable table 10 of the present invention, as best illustrated in FIG. 5, the rear extension member 36 has at least one adjustable swivel leg 72. The adjustable swivel leg 72 preferably has a swivel joint and a non-skid support footing 48, i.e. a vinyl bumper, rubber stripping, suction cups, etc., inhibiting movement of the adjustable table 10 on the table surface 16. At least one washer 75 and a wing nut 74 or the like is attached to a bolt 76 or the like extending through the adjustable swivel leg 72 and support leg 68 to releasably secure the adjustable swivel leg 72 to the support leg 68.

Figure 6:
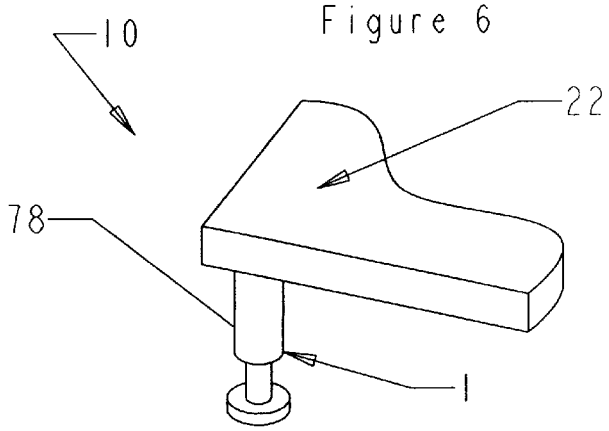
FIG. 6 is a perspective view of yet still another embodiment of the adjustable table assembly an adjustment means positionable on a table surface and constructed in accordance with the present invention.
Figure 7:
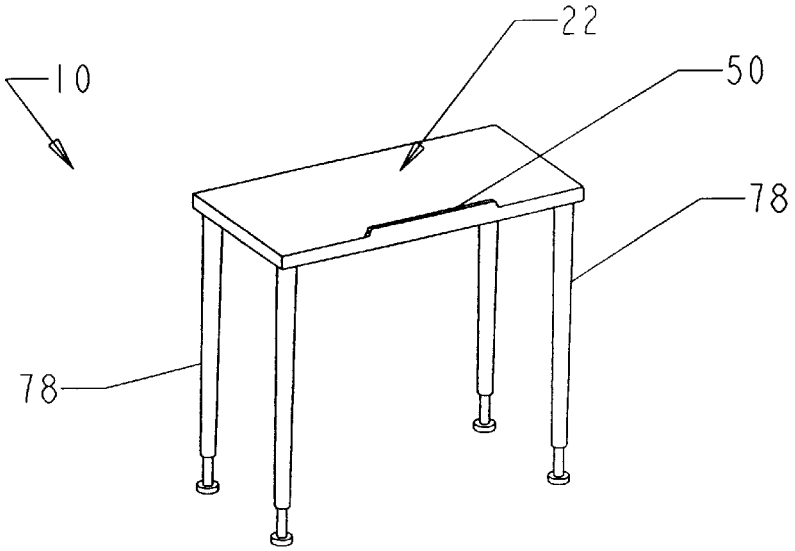
FIG. 7 is a perspective view of a further embodiment of the adjustable table assembly and adjustment means which is standable on the floor without a table surface constructed in accordance with the present invention.

In still yet another embodiment of the adjustable table 10 of the present invention, as best illustrated in FIGS. 6 and 7, the main table base 22 has a pair of telescoping swivel-based legs 78 mounted adjacently near the first side edge 28 of the main table base 22. The telescoping legs 78 are adjustable to achieve the operator's desired tilt of the adjustable table 10. Furthermore, as illustrated in FIG. 7, additional telescoping legs 78 can also be mounted adjacently near the second side edge 30 of the main table base 30. Mounting at least four telescoping legs 78 in the manner described provides the adjustable table 10 of the present invention the ability to function as a stand-alone piece of furniture for use without a table surface 16.

It is further within the scope of the present invention to mount the telescoping legs 78 directly onto or into the base portion 14 of the sewing machine 12 without the adjustable table 10. The telescoping legs 78 could be mounted in the base portion 14 of the sewing machine 12, in a separate base (not shown) attachable to the base portion 14 of the sewing machine 12, or extend through the base portion 14 of the sewing machine 12 onto the table surface 16. The telescoping legs 78 could either be manufactured into the sewing machine 12 during the manufacturing process or added by the operator for use after purchase of the sewing machine 12. Use of the telescoping legs 78 in this manner further allow the sewing machine 12 to be tilted in an existing sewing machine cabinet (not shown) to tilt the sewing machine 12 toward the operator while the sewing machine 12 rests within the cabinet.

Figure 8:
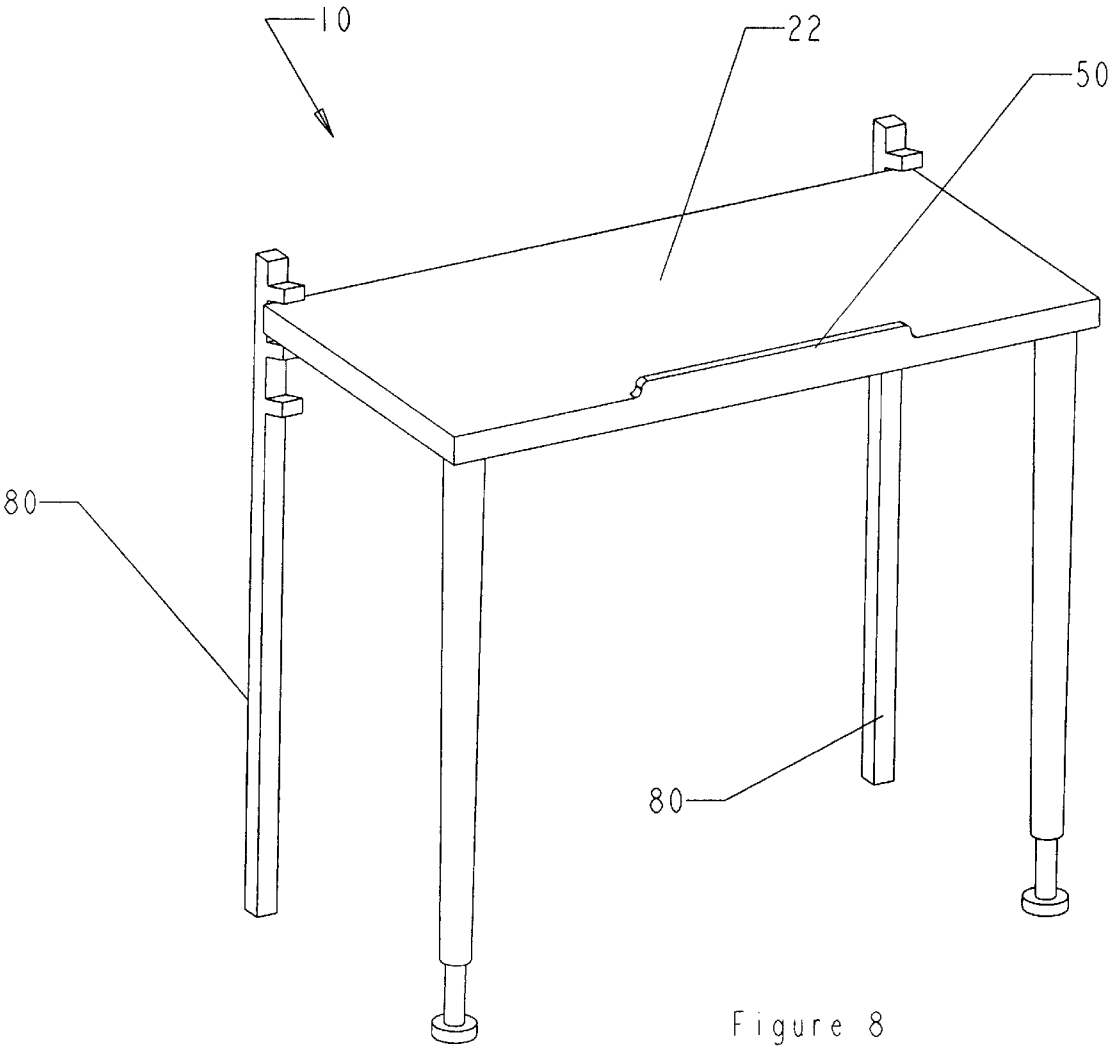
FIG. 8 is a perspective view of another further embodiment of the adjustable table assembly adjustment means which is standable on the floor without a table surface constructed in accordance with the present invention.

In a further embodiment of the adjustable table 10 of the present invention, as best illustrated in FIG. 8, the adjustable table 10 does not include the rear extension member 36 but rather has at least one notched leg 80 for receiving the first side edge 28 of the main table base 22. The adjustable table 10 of this embodiment is particularly useful for tilting heavier adjustable tables 10 which are beneficial for heavier brand portable sewing machines 12.

Figure 9:
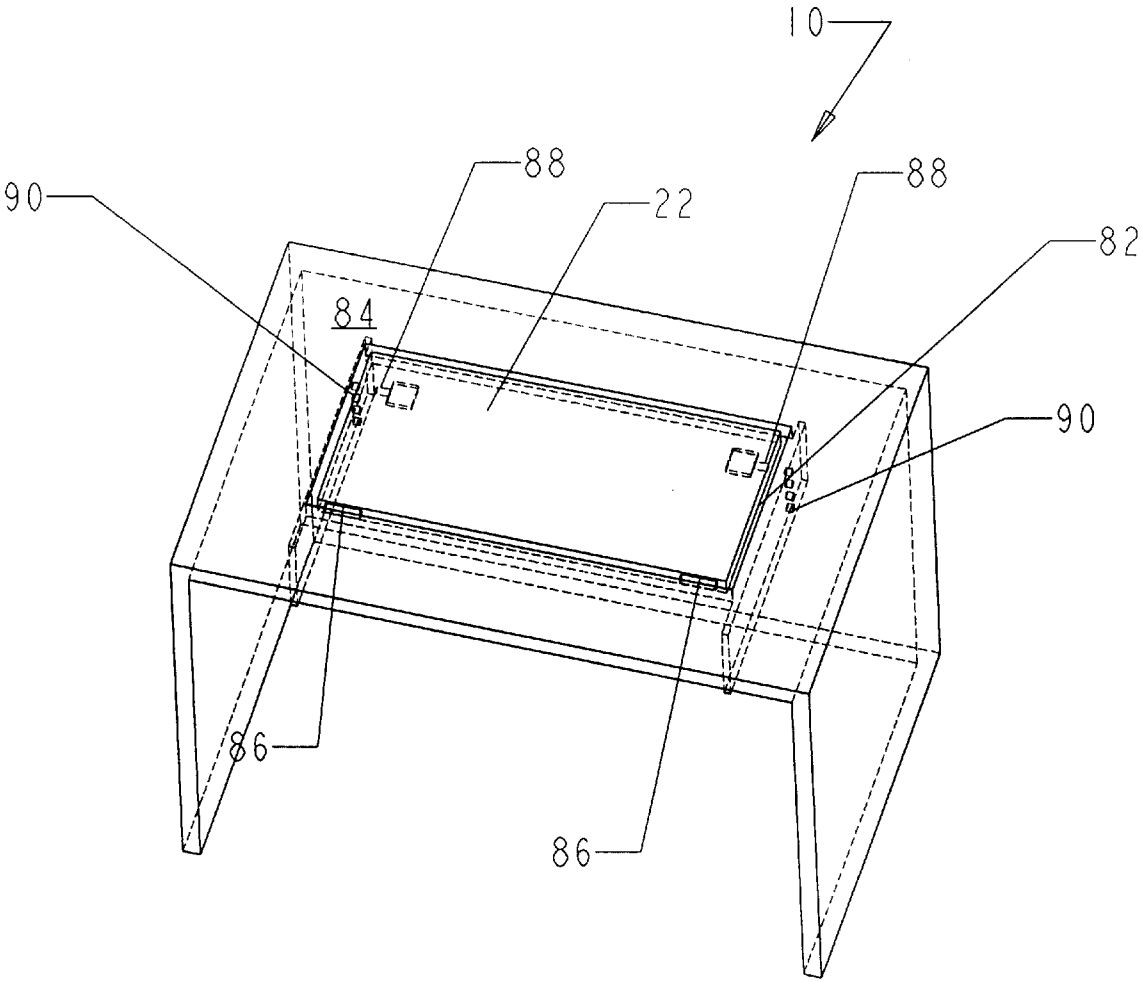
FIG.9 is a perspective view of a yet further embodiment of the adjustable table assembly and adjustment means for use within a sewing machine cabinet and constructed in accordance with the present invention.

In another further embodiment of the adjustable table 10 of the present invention, as illustrated in FIG. 9, the adjustable table 10 is adaptable for use within standard sewing machine cabinets. Typically, the sewing machine cabinets have a movable sewing machine tray 82 mounted within the cabinet for receiving the sewing machine 12. The sewing machine 12 is typically raised and lowered by a pneumatic, hydraulic, or spring-type mechanism attached to the back wall 84 of the cabinet and the movable tray 82. Generally, the movable tray 82 is maintained at a ninety (90°) degree angle to the top surface (not shown) of the cabinet when in the sewing position. In some instances, the movable tray 82 raises and lowers horizontal to the top surface of the cabinet accommodating the operator's needs and to store the sewing machine 12 within the sewing cabinet. The movable tray 12 is oftentimes constructed of a wood material matching the material of the sewing cabinet and has a plurality of apertures (not shown) therein for mounting different portable sewing machines 12 on the movable tray 82.

As illustrated in FIG. 9, in this embodiment of the present invention, the adjustable table 10 of the present invention is mounted to the movable tray 82 by a at least one hinge 86 mounted nearingly adjacent the second side edge 30 of the main table base 22. A pin 88 or the like is mounted nearingly adjacent each of the third and fourth side edges 32, 34 of the main table base 22 receivable within substantially vertically-aligned apertures 90 formed in the sewing cabinet. Tilt adjustment of the adjustable table 10 would be accomplished by inserting the pin 88 into the desired aperture 90 in the sewing cabinet to achieve the desired tilt angle of the adjustable table 10.

Figure 10:
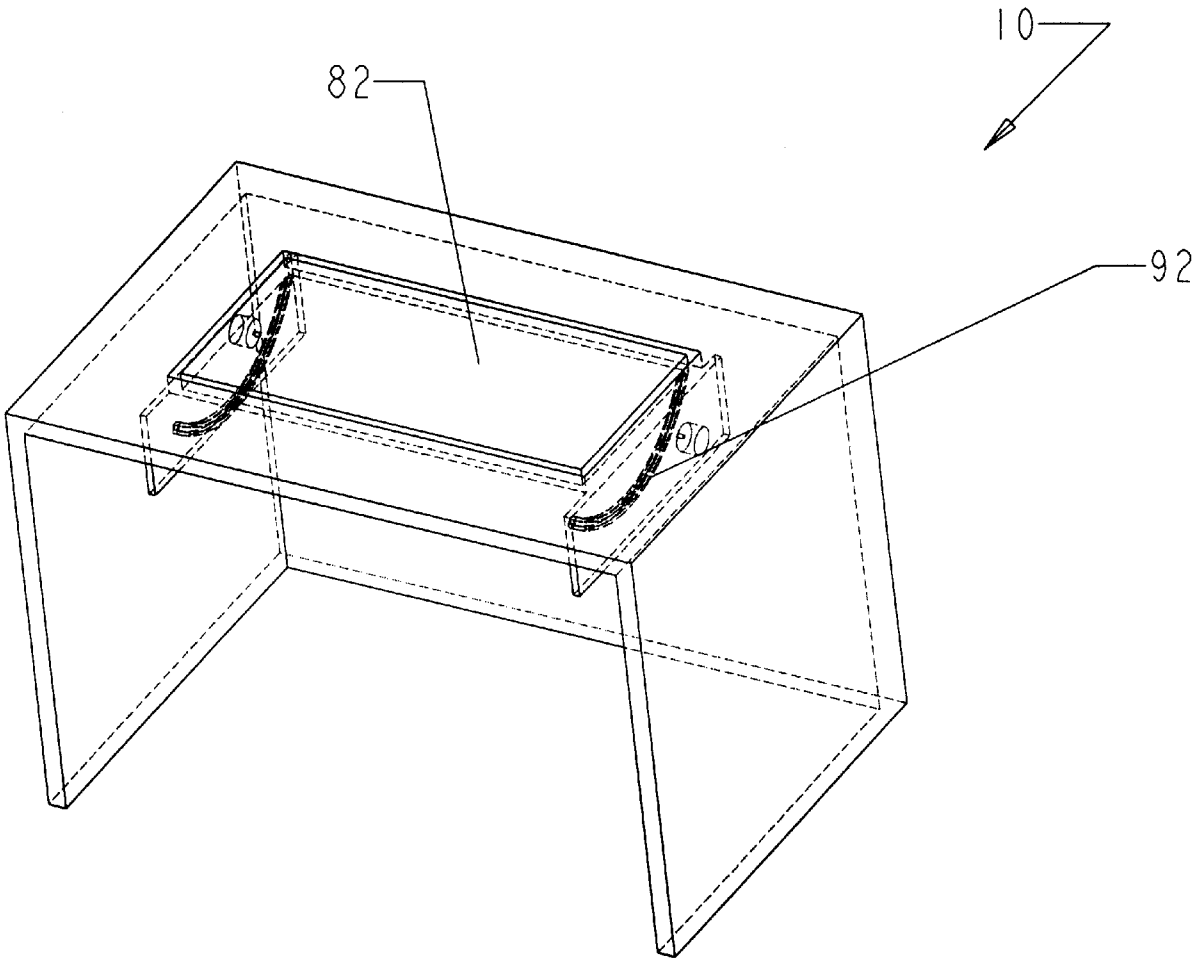
FIG. 10 is a perspective view of another embodiment of the adjustment means of the adjustable table of the present invention for use within a sewing machine cabinet and constructed in accordance with the present invention.

In yet a further embodiment of the adjustable table 10 of the present invention for tilting the sewing machine 12 within a sewing cabinet, as illustrated in FIG. 10, would be to replace the original ninety (90°) bracket typically present in some sewing cabinet brands with an adjustable bracket 92 that would allow the movable tray 82 to tilt the second side edge 30 toward the operator. The movable tray 82 then becomes the adjustable table 10 by selectively adjusting the adjustable bracket 92 to the desired tilt angle.

In some sewing cabinets manufactured today, as illustrated in FIG. 11, the movable tray has cam followers or guide pins 94*a* mounted thereon for following channels 94 formed in the side panels of the sewing cabinets to raise and lower the sewing machine 12 out of and within the sewing cabinet. Receiving points 96 in the side panels of the sewing cabinet adjust the horizontal height of the sewing machine. As illustrated in FIG. 11, the present invention further comprises reconfiguring the channels 94 or mounting different reconfigured receiving points 96 in the side panels of the sewing cabinet to allow the desired tilt of the movable tray 82.

Figure 12:
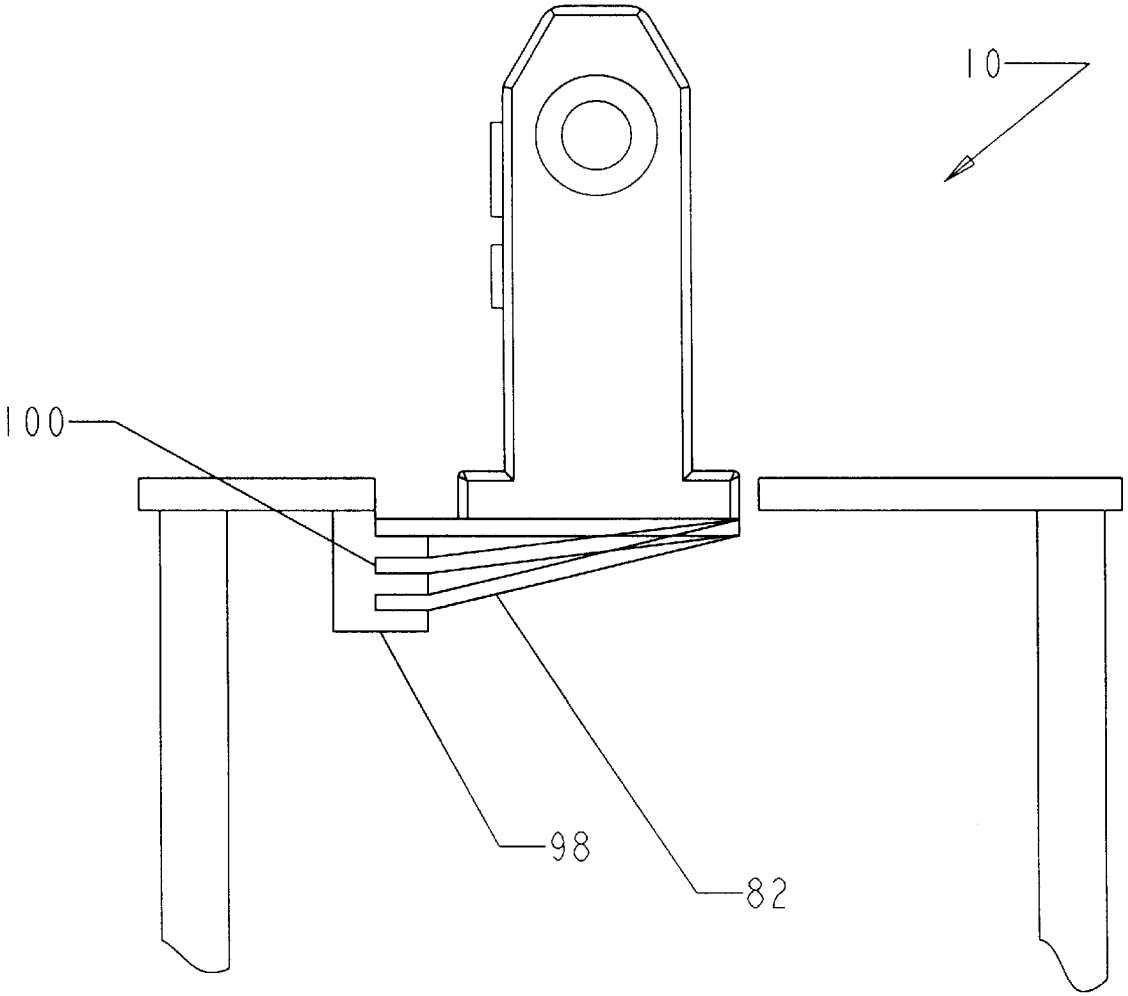
FIG. 12 is a perspective view of still another embodiment of the adjustment means of the adjustable table of the present invention for use within a sewing machine cabinet and constructed in accordance with the present invention.

In another embodiment of the present invention, as best illustrated in FIG. 12, an adjustment mechanism 98 is mounted to the sewing cabinet. The adjustment mechanism 98 has a plurality of notches 100 for receiving the movable tray 82 therein. The movable tray 82 can be selectively inserted into one of the notches 100 to achieve the desired tilt of the movable tray 82.

Figure 13:
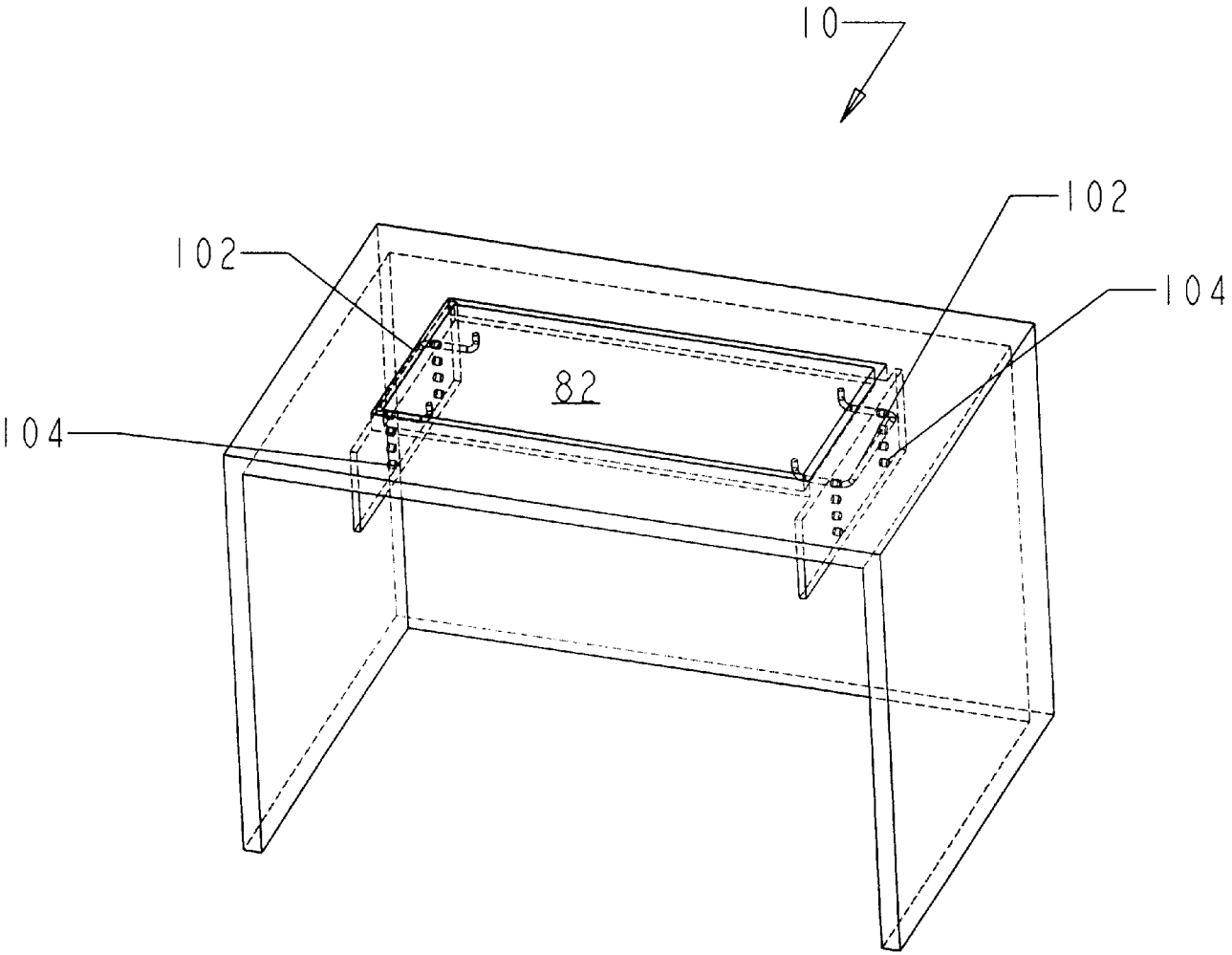
FIG. 13 is a perspective view of yet still another embodiment.

In still another embodiment of the present invention, as best illustrated in FIG. 13, a pair of adjustment bars 102 are mounted on each side of the movable tray 82. Corresponding bar receiving hooks 104 are mounted on the side walls of the sewing cabinet. The movable tray 82 is adjustable to the desired tilt angle by positioning the adjustment bars 102 in the desired receiving hooks 104 at appropriate positions.

The adjustable table 10 of the present invention, whether placed on a table surface 16, mounted within a sewing cabinet, or by reconfiguring the mechanisms present in typical sewing machine cabinets, achieves the desired and healthful and correct ergonomic tilt of the sewing machine 12. By tilting the sewing machine 12 with the use of the present invention, operators will have increased productivity and better enjoyment in sewing operations. Furthermore, the health of the operators will be enhanced by tilting the sewing machine thereby allowing the operators to comfortably and correctly position their bodies to achieve the desired sewing result.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

We claim:

1. An adjustable table assembly for use with a portable sewing machine and positionable upon a table surface, the assembly comprising:

a main table base having a first edge, a second edge opposite the first edge, and a substantially planar top surface between the first edge and the second edge;

a support member mounted to the first edge of the main table base and extending at an angle from the top surface of the main table base, the support member creating a tilt angle between the main table base and the table surface; and adjustment means associated with the support member for selectively adjusting the tilt angle of the main table base to a desired tilt angle, the main table base receiving the sewing machine, the sewing machine being tilted at a desired tilt angle, the adjustment means comprising an adjustment leg having a plurality of varying depth slots, the support member capable of being received within each of the slots.

2. The assembly as claimed in claim 1 and further comprising clamping means for releasably securing the main table base to the table surface.

3. The assembly as claimed in claim 1 wherein the main table base has a bottom surface opposite the top surface, and further comprising movement inhibiting means mounted to the bottom surface adjacent the second side edge of the main table base for inhibiting movement of the main table base relative to the table surface.

4. The assembly of claim in claim 3 wherein the movement inhibiting means comprises a member selected from the group consisting of nylon bumpers, rubber bumpers, and suction cups.

5. The assembly as claimed in claim 1 and further comprising an aperture formed in the main table base, an electrical cord on the sewing machine receivable within the aperture.

6. The assembly as claimed in claim 1 and further comprising a lip member mounted to the second side edge of the main table base.

7. The assembly as claimed in claim 1 wherein the desired tilt angle is between approximately seven degrees and thirty degrees.

8. An adjustable table assembly for use with a portable sewing machine and positionable upon a table surface, the assembly comprising:

a main table base having a first edge, a second edge opposite the first edge, and a substantially planar top surface between the first edge and the second edge;

a support member mounted to the first edge of the main table base and extending at an angle from the top surface of the main table base, the support member creating a tilt angle between the main table base and the table surface; and adjustment means associated with the support member for selectively adjusting the tilt angle of the main table base to a desired tilt angle, the main table base receiving the sewing machine, the sewing machine being tilted at a desired tilt angle, the adjustment means comprising the support member having a plurality of notches of varying depth, and further comprising an adjustment leg having a notch, the notch of the support member matingly received within the slots.

9. The assembly as claimed in claim 8 and further comprising clamping means for releasably securing the main table to the table surface.

10. The assembly as claimed in claim 8 wherein the main table base has a bottom surface opposite the top surface, and further comprising movement inhibiting means mounted to the bottom surfaces adjacent the second side edge of the main table base for inhibiting movement of the main table base relative to the table surface.

11. The assembly of claim in claim 10 wherein the movement inhibiting means comprises a member selected from the group consisting of nylon bumpers, rubber bumpers, and suction cups.

12. The assembly as claimed in claim 8 and further comprising an aperture formed in the main table base, an electrical cord on the sewing machine receivable with the aperture.

13. The assembly as claimed in claim 8 and further comprising a lip member mounted to the second side edge of the main table base.

14. The assembly as claimed in claim 8 wherein the desired tilt angle is between approximately ten degrees and thirty degrees.

* * * * *